US008303198B2

(12) United States Patent
Nishimura et al.

(10) Patent No.: US 8,303,198 B2
(45) Date of Patent: Nov. 6, 2012

(54) LABEL PAPER INDEXING CONTROL METHOD AND LABEL PRINTER

(75) Inventors: Hideki Nishimura, Matsumoto (JP); Ichimi Masuda, Shiojiri (JP); Junichi Arai, Chiryu (JP)

(73) Assignee: Seiko Epson Corporation, Tokyo (JP)

( * ) Notice: Subject to any disclaimer, the term of this patent is extended or adjusted under 35 U.S.C. 154(b) by 648 days.

(21) Appl. No.: 12/537,932

(22) Filed: Aug. 7, 2009

(65) Prior Publication Data

US 2010/0032466 A1 Feb. 11, 2010

(30) Foreign Application Priority Data

Aug. 7, 2008 (JP) ..... 2008-203899

(51) Int. Cl.
*B41J 29/38* (2006.01)
*B41J 11/46* (2006.01)
*B41J 11/42* (2006.01)

(52) U.S. Cl. ..... 400/76; 400/611; 358/1.18

(58) Field of Classification Search ..... 400/76, 400/88, 611
See application file for complete search history.

(56) References Cited

U.S. PATENT DOCUMENTS 4,397,709 A * 8/1983 Schwenzer ..... 156/351
5,189,470 A * 2/1993 Matsuda et al. ..... 399/68
5,564,846 A * 10/1996 Katsumata ..... 400/611
6,516,440 B1 * 2/2003 Teradaira ..... 714/763
8,223,182 B2 * 7/2012 Komatsu ..... 347/218
2008/0181708 A1 * 7/2008 Yamaguchi et al. ..... 400/613
2009/0122345 A1 * 5/2009 Tanaka ..... 358/1.16
2009/0230339 A1 * 9/2009 Ushigusa et al. ..... 251/129.05

FOREIGN PATENT DOCUMENTS

JP 06099622 A 4/1994
JP 06227066 A 8/1994
JP 07246738 A 9/1995
JP 2003312070 A 11/2003
JP 2005199595 A * 7/2005
JP 2006035524 A 2/2006

* cited by examiner

*Primary Examiner* — Daniel J Colilla
(74) *Attorney, Agent, or Firm* — Nutter McClennen & Fish LLP; John J. Penny, Jr.; Christina M. Sperry

(57) ABSTRACT

A label paper indexing control method for a label printer is provided that in one embodiment includes conveying label paper having labels affixed with a specific gap there between to a continuous liner through a path passed a printing position of a print head, detecting a reference position of the label paper at a detection position upstream from the print head, determining the position of a downstream label end of a label on the path as a first distance from the detection position based on when the reference position is detected, updating the first distance each time the label paper is conveyed, executing a power shutdown operation that writes the first distance to memory and turns the power off when a command instructing turning the power off is asserted, and reading the first distance from memory when the power turns on without the label paper having been replaced.

11 Claims, 9 Drawing Sheets

MANAGEMENT TABLE

| | | | |
|---|---|---|---|
| LABEL B | (1) | DOWNSTREAM LABEL END J | : N (1) |
| LABEL B | (1) | UPSTREAM LABEL END K | : O (1) |
| LABEL B | (2) | DOWNSTREAM LABEL END J | : N (2) |
| LABEL B | (2) | UPSTREAM LABEL END K | : O (2) |
| LABEL B | (3) | DOWNSTREAM LABEL END J | : N (3) |
| LABEL B | (3) | UPSTREAM LABEL END K | : O (3) |

⋮ ⋮

LABEL PAPER INDEXING CONTROL METHOD AND LABEL PRINTER

BACKGROUND

1. Technical Field

The present invention relates to a label printer that conveys and prints to label paper having labels affixed with a specific interval there between on a continuous liner. The invention relates more particularly to a label paper indexing control method and to a label printer that can reduce the number of labels that are wasted by being positioned downstream in the transportation direction from the printing position when indexing the label paper to position the target printing start position that is preset on the labels to the printing position of the print head.

2. Related Art

When the power is turned on for a label printer that conveys and prints to label paper having labels affixed with a specific interval there between on a continuous liner through a paper transportation path that passes the printing position of the print head, an indexing operation is executed to position the target printing start position preset on the labels to the printing position. Indexing is accomplished by conveying the label paper through the paper transportation path, detecting a reference position such as the leading edge of the labels or index marks on the liner by means of a photo sensor disposed to a detection position on the paper transportation path, and conveying the liner only a predetermined distance from when the reference position (mark) is detected. When indexing ends, printing can proceed based on print commands and print data supplied to the label printer from an external device, for example.

The label printer taught in Japanese Unexamined Patent Appl. Pub. JP-A-2003-312070 detects the reference position for indexing at a detection position that is downstream from the printing position. The label printer taught in Japanese Unexamined Patent Appl. Pub. JP-A-H07-246738 detects the reference position for indexing at a detection position upstream from the printing position.

In order to detect the reference position, the liner must be conveyed passed the detection position and change in the output level of a signal from a photo sensor or other detector must be obtained. Therefore, when indexing is done after the power is turned on, a label with a reference position on the upstream side of the detection position is used as the target label to be indexed (referred to as the "target label" or "indexing target label" below), and the target printing start position of this target label is positioned to the printing position while conveying the liner downstream. After indexing is completed, printing starts from the indexed target label.

When indexing occurs in a label printer in which the detection position is set upstream from the printing position, labels that are downstream from the target label will pass the printing position and be positioned downstream from the printing position. Because printing starts from the target label, labels that are downstream from the target label will not be used for printing and will be needlessly consumed. More particularly, when the print head is an inkjet head, a long distance is provided between the printing position of the inkjet head and the detection position of the photo sensor in order to prevent spray from the ink droplets, for example, discharged from the inkjet head from soiling the photo sensor. As a result, there are plural labels located between the detection position and the printing position, and all of these plural labels will be wasted if the reference position of the target label to be indexed is upstream from the detection position.

SUMMARY

A label paper indexing control method and a label printer according to the present invention can reduce the number of labels that are wasted by indexing each time the power turns on.

A label paper indexing control method for a label printer, including steps of: conveying label paper having labels affixed with a specific gap there between to a continuous liner through a paper transportation path passed a printing position of a print head; detecting a reference position of the label paper at a detection position upstream from the print head; determining the position of a downstream label end of a label on the paper transportation path as a first distance from the detection position based on when the reference position is detected; updating the first distance each time the label paper is conveyed; executing a power shutdown operation that writes the first distance to nonvolatile memory and turns the power off when a power off command instructing turning the power off is asserted; and reading the first distance from nonvolatile memory when the power turns on without the label paper having been replaced.

A label paper indexing control method for a label printer according to according to another aspect of the invention includes steps of conveying label paper having labels affixed with a specific gap there between to a continuous liner through a paper transportation path passed a printing position of a print head; detecting a reference position of the label paper at a detection position upstream from the print head; determining the position of an upstream label end of a label on the paper transportation path as a second distance from the detection position based on when the reference position is detected; updating the second distance each time the label paper is conveyed; executing a power shutdown operation that writes the second distance to nonvolatile memory and turns the power off when a power off command instructing turning the power off is asserted; and reading the second distance from nonvolatile memory when the power turns on without the label paper having been replaced.

A label paper indexing control method for a label printer according to according to another aspect of the invention positions a target printing start position that is predetermined for the label to the printing position based on the first distance and/or second distance.

The invention detects a reference position of the label paper at a detection position, determines the position of a downstream label end of a label on the paper transportation path as a first distance from the detection position based on when the reference position is detected or determines the position of an upstream label end of a label on the paper transportation path as a second distance from the detection position based on when the reference position is detected, and updates the first distance or second distance each time the label paper is conveyed. When a power off command instructing turning the power off is asserted, the first distance or second distance is written to nonvolatile memory. If the power is then turned on again without the label paper having been replaced, the first distance or second distance is read from nonvolatile memory, and an indexing operation is executed to position the target printing start position of the label to the printing position based on the first distance and/or second distance.

Because positioning the label paper after the power turns on again is based on the first distance or second distance that is determined according to the reference position detected before the power turned off, the label that is closest to the printing position or is closest to the printing position on the upstream side of the printing position can be set as the label that is indexed to the printing position. More specifically, because it is not necessary to use a label of which the reference position is on the upstream side of the detection position as the label that is indexed to the printing position when the power turns on, the number of labels that become positioned downstream from the printing position when indexing is completed can be reduced or held to zero. The number of labels that are wasted by indexing when the power turns on again can therefore be reduced.

Note that the reference position can be an indexing mark on the backing liner. The reference position may also be the downstream label end or upstream label end of the labels.

In addition, because this aspect of the invention determines the position of the upstream label end on the transportation path as the second distance for indexing when the power turns on again, the location of the gap between labels can also be determined from the first distance and second distance. The location of the gap between labels may also be determined from the first distance or second distance.

In order to determine the position on the paper transportation path of the target cutting position set on the label paper, the cutting position is preferably located on the downstream side of the print head on the paper transportation path in according to another aspect of the invention, the position on the paper transportation path of the target cutting position predetermined for the label paper is determined as a third distance from the detection position based on the first distance and/or second distance, the third distance is written to nonvolatile memory when the power off command is asserted, and the third distance is read from nonvolatile memory when the power turns on. Further preferably, the third distance is updated each time the label paper is conveyed.

Yet further preferably, to prevent, for example, printing on the liner when the printing length of the print data is longer than the length in the transportation direction of each label on the label paper that is used for printing due to an error setting the data length of the print data, another aspect of the invention acquires the printable length in the transportation direction of the label based on the first distance and/or second distance, writes this printable length to nonvolatile memory when a power off command is asserted, reads the printable length from nonvolatile memory when the power turns on, and applies a masking process when the print length in the transportation direction of the supplied print data that is printed to the label exceeds the printable length so that the part of the print data other than the data corresponding to the printable length does not print. This can prevent printing across a plurality of labels and wasting the labels.

Yet further preferably, to prevent, for example, printing on the liner when the printing length of the print data is longer than the length in the transportation direction of each label on the label paper that is used for printing due to an error setting the data length of the print data, another aspect of the invention preferably applies a masking process to the print data based on the first distance and second distance so that the supplied print data is not printed in the gaps between labels when printing by means of the print head after the power turns on.

Yet further preferably, to avoid, for example, printing to a position outside the liner and thereby soiling the platen that guides the liner when the printing width of the print data is greater than the liner width of the liner part of the label paper that is set in the transportation path because of an error setting the print width of the print data, another aspect of the invention preferably acquires the liner width of the liner paper on the paper transportation path, writes the liner width to nonvolatile memory when a power off command is asserted, reads the liner width from nonvolatile memory when the power turns on, and applies a masking process when the printing width of the supplied print data is greater than the liner width so that the data portion of the print data that is printed outside the liner width or a label width that is narrower by a specific dimension than the liner width is not printed.

To determine the paper type of the label paper set in the transportation path, another aspect of the invention further preferably writes the paper type of the label paper acquired based on a control command from an external device to the nonvolatile memory when the power off command is asserted, and reads and acquires the paper type from nonvolatile memory when the power turns on.

Yet further preferably, another aspect of the invention has a photo sensor to the detection position, sets a specific threshold value according to an output level of a signal from the photo sensor and/or the paper type, detects the reference position based on the output level and threshold value, writes the threshold value as a sensor setting value to nonvolatile memory when the power off command is asserted, and reads and sets the sensor setting value from nonvolatile memory as the threshold value when the power turns on.

When the threshold value for detecting the reference position is selectively set based on the output level of a signal from the photo sensor or the paper type of the label paper, the reference position can be detected using an appropriate threshold value.

Yet further preferably, another aspect of the invention starts the power shutdown operation when the power off command is asserted, and writes the first distance and the second distance to nonvolatile memory while the circuit voltage drops.

The circuitry has an electrostatic capacitance component, and the voltage drops through a voltage range in which the circuit can be driven for a specific time. Because the first distance and second distance can be saved to nonvolatile memory while the power shutdown operation executes using this time, the time from when the power off command is asserted until the power turns off can be shortened compared with a configuration in which the power shutdown operation starts after the first distance and second distance are written to nonvolatile memory.

Another aspect of the invention is a label printer that indexes the label paper using the indexing control method described above.

EFFECT OF THE INVENTION

The invention detects a reference position of the label paper at a detection position, determines the position of a downstream or upstream label end of a label on the paper transportation path as a first distance or second distance from the detection position based on when the reference position is detected, and updates the first distance or second distance each time the label paper is conveyed. When a power off command instructing turning the power off is asserted, the first distance or second distance is written to nonvolatile memory. If the power is then turned on again without the label paper having been replaced, the first distance or second distance is read from nonvolatile memory, and an indexing operation is executed to position the target printing start position of the label to the printing position based on the first distance and/or second distance.

Because indexing the label paper after the power turns on again is based on the first distance or second distance that is determined according to the reference position detected before the power turned off, the label that is closest to the printing position or is closest to the printing position on the upstream side of the printing position can be set as the label that is indexed to the printing position. In other words, because it is not necessary to use a label of which the reference position is on the upstream side of the detection position as the label that is indexed to the printing position when the power turns on, the number of labels that become positioned downstream from the printing position when indexing is completed can be reduced or held to zero. The number of labels that are wasted by indexing the labels for printing when the power turns on again can therefore be reduced.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 8 is a flow chart of the indexing control operation when the power turns on.

DESCRIPTION OF EXEMPLARY EMBODIMENTS

A label printer according to a preferred embodiment of the present invention is described below with reference to the accompanying figures.

General Configuration

Figure 1:
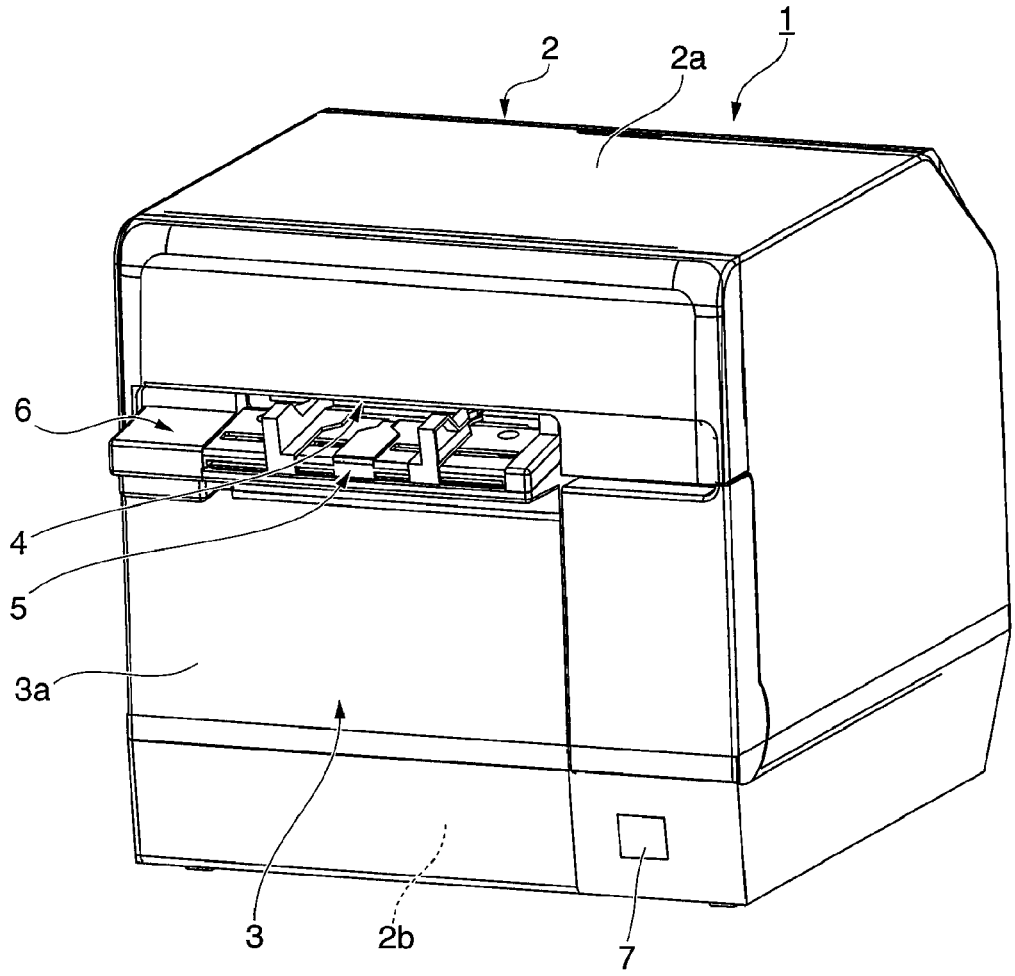
FIG. 1 is an external oblique view of a label printer according to a preferred embodiment of the invention.
Figure 2:
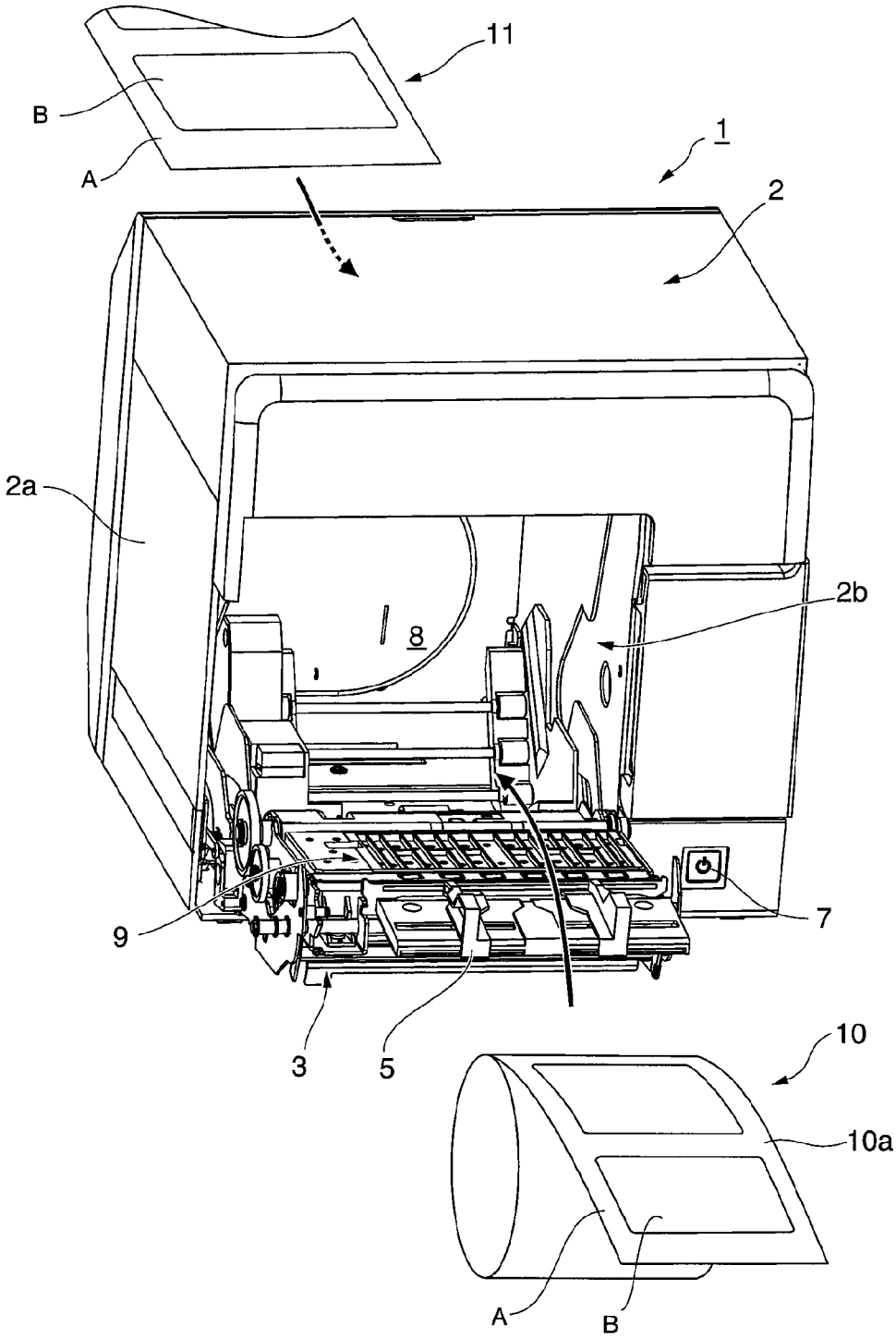
FIG. 2 is an external oblique view of the label printer with the access cover open.

FIG. 1 is an oblique view showing a label printer according to a first embodiment of the invention. FIG. 2 is an oblique view of the printer with the cover completely open.

The label printer 1 has a rectangular box-like body 2 and an access cover 3 that opens and closes and is disposed to the front of the body 2. A recording paper exit 4 of a specific width is formed at the front of the outside case 2*a* part of the printer body 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3. A pushbutton type power switch 7 is disposed to the front of the outside case 2*a* at a place on the right side of the cover 3.

Operating the cover opening lever 6 unlocks the cover 3. When the exit guide 5 is pulled forward, the cover 3 pivots at the bottom end part thereof and opens forward to a substantially horizontal position as shown in FIG. 2. When the cover 3 opens, the roll paper compartment 8 formed inside the printer case 2 opens. The vacuum platen 9 that determines the printing position moves with the cover 3 at the same time, and the space from the roll paper compartment 8 to the paper exit 4 opens so that the roll paper 10 can be easily loaded and replaced from the front of the printer.

Figure 3:
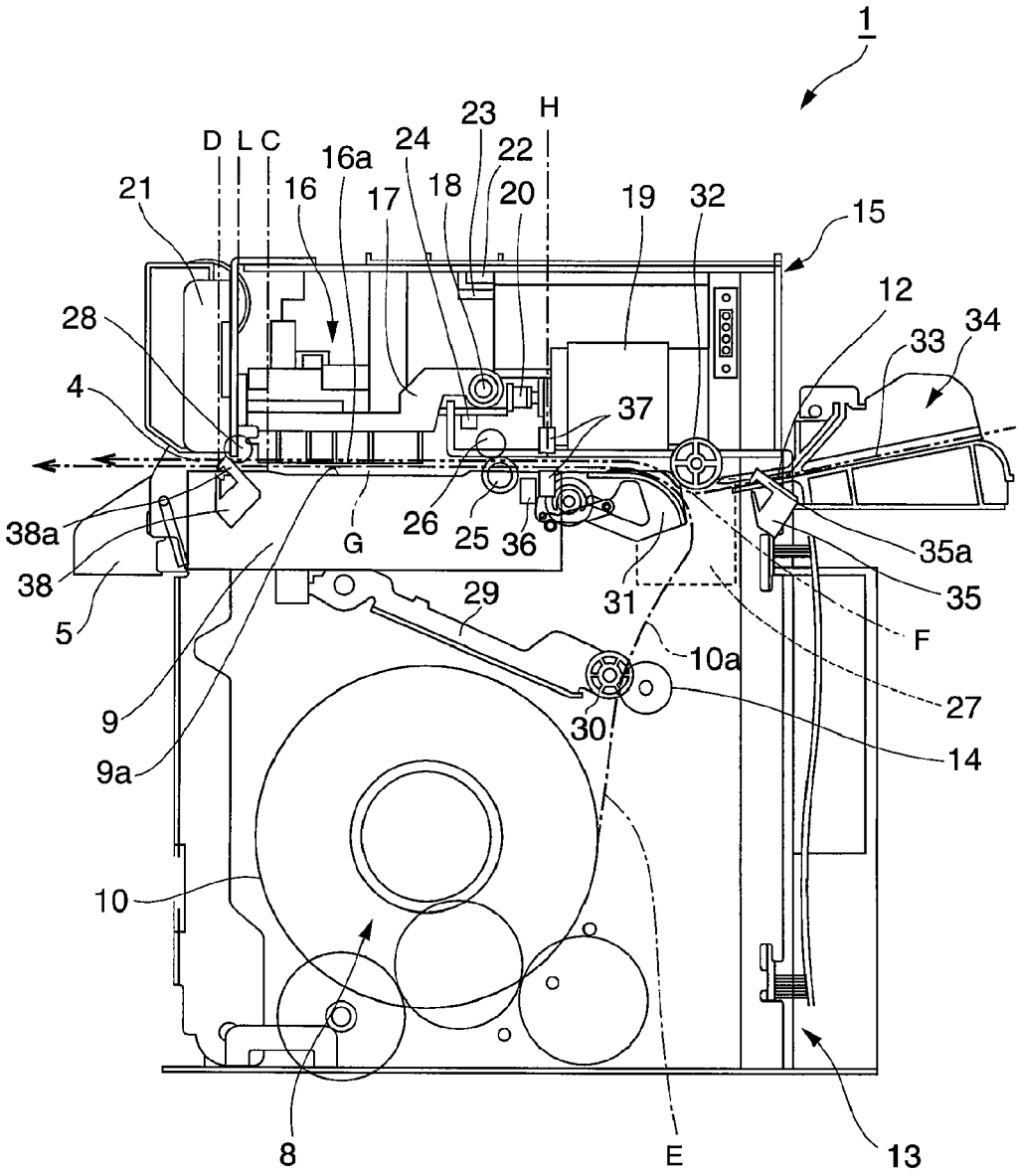
FIG. 3 is a vertical section view showing the internal structure of the label printer.

The label printer 1 can also can also use fanfold paper 11, and fanfold paper 11 is manually inserted into the printer case 2 from a recording paper insertion opening 12 formed in the back of the printer case 2 (see FIG. 3). The roll paper 10 and fanfold paper 11 are both label paper having labels B affixed to a liner A with a constant interval between the labels. Note that the cover case of the cover 3 and the cover opening lever 6 are not shown in FIG. 2.

FIG. 3 shows the internal configuration of the label printer 1. A roll paper compartment 8 is formed in the center between the side walls of the printer frame 13 inside the label printer 1. Roll paper 10 is loaded inside the roll paper compartment 8 facing the width of the printer so that the roll paper can roll on its side.

A head unit frame 15 is disposed horizontally at the top of the printer frame 13 above the roll paper compartment 8. Disposed to the head unit frame 15 are an inkjet head 16, a carriage 17 that carries the inkjet head 16, and a carriage transportation mechanism including a carriage guide shaft 18 that guides movement of the carriage 17 widthwise to the printer, and a carriage motor 19 and timing belt 20 for moving the carriage 17 bidirectionally along the carriage guide shaft 18. The inkjet head 16 is mounted on the carriage 17 with the ink nozzle surface 16*a* facing down. An automatic paper cutter 21 having a movable knife protruding down is disposed at the front end of the head unit frame 15.

A linear scale 22 and encoder sensor 23 for detecting the movement position of the inkjet head 16 that moves mounted on the carriage 17 are disposed to the head unit frame 15. The linear scale 22 is located above the inkjet head 16. The encoder sensor 23 is mounted with the inkjet head 16 on the carriage 17. A paper width detector 24 for detecting the liner width of the liner A of the recording paper 10*a* or the fanfold paper 11 passing under the inkjet head 16 is also mounted on the carriage 17. The paper width detector 24 is a reflection photo sensor that uses variation in the reflectivity of a detection beam emitted while the carriage 17 moves to detect the left and right edges of the recording paper 10*a* or fanfold paper 11.

A vacuum platen 9 extending horizontally widthwise to the printer is disposed below the inkjet head 16 with a specific gap there between. The vacuum platen 9 is rectangular and has a plurality of suction holes rendered in a specific area of the platen surface 9*a*. The vacuum platen 9 can pull the recording paper 10*a* or fanfold paper 11 conveyed there above to the platen surface 9*a* by drawing air through these suction holes by means of a vacuum mechanism not shown, and can thereby keep the platen gap constant.

A paper feed roller 25 is disposed horizontally widthwise to the printer behind the vacuum platen 9, and a paper pressure roller 26 of a specific width is pressed with a specific pressure to the paper feed roller 25. The paper feed roller 25 is driven by a paper feed motor 27 that is mounted on the printer frame 13.

A front paper pressure roller 28 is disposed at a position at the front end side of the vacuum platen 9. The front paper pressure roller 28 is used to prevent the recording paper 10*a* or fanfold paper 11 from rising, and turns by means of the recording paper 10*a* or fanfold paper 11 passing over the platen surface 9*a*.

An exit guide 5 is disposed to the front end of the vacuum platen 9. A gap of a specific width is open at a position between the printer frame 13 and head unit frame 15 at the front end of the vacuum platen 9, and this gap is the paper exit 4.

A roll paper pressure lever 29 is disposed below the vacuum platen 9 extending diagonally downward to the back. The roll paper pressure lever 29 is urged down by the force of a spring, and a roll paper pressure roller 30 disposed to the distal end of the lever is pressed with specific pressure against a delivery roller 14.

A tension guide 31 that curves downward is attached to the back end of the vacuum platen 9. The web of recording paper 10*a* pulled from the roll paper 10 in the roll paper compartment 8 is pulled out so that after passing the delivery roller 14 and tension guide 31 it curves forward, and is then conveyed through the roll paper transportation path E extending horizontally from the back end of the vacuum platen 9 passed the printing position C of the inkjet head 16, the cutting position D of the automatic paper cutter 21, and out from the paper exit 4. The tension guide is urged upward by the force of a spring so that a specific tension is applied to the recording paper 10*a* as it passes the tension guide 31.

A rear paper pressure roller 32 is disposed behind the tension guide 31. A recording paper insertion opening 12 for accepting fanfold paper 11 from the back of the printer case 2 is formed at a part of the printer frame 13 behind the rear paper pressure roller 32. A fanfold paper holder 34 having a guide path to guide the fanfold paper 11 to the recording paper insertion opening 12 is disposed on the outside of the printer frame 13 where the recording paper insertion opening 12 is formed.

The fanfold paper 11 manually inserted from the guide path 33 is inserted so that it passes the recording paper insertion opening 12 and rear paper pressure roller 32, and is then conveyed through a fanfold paper transportation path F that extends horizontally from the back end of the vacuum platen 9 passed the printing position C of the inkjet head 16 and the cutting position D of the automatic paper cutter 21 to the paper exit 4.

The roll paper transportation path E and the fanfold paper transportation path F merge at the back end of the vacuum platen 9, and the part extending from the back end of the vacuum platen passed the printing position C of the inkjet head 16, the cutting position D of the automatic paper cutter 21, and to the paper exit 4 is thus a common paper transportation path G shared by both. When the leading end of the recording paper 10*a* or fanfold paper 11 reaches the common paper transportation path G, the recording paper 10*a* or fanfold paper 11 is conveyed through the common paper transportation path G by a transportation means including the paper feed motor 27 and paper feed roller 25 driven rotationally by the paper feed motor 27.

A paper insertion detector 35 for detecting if the fanfold paper 11 is present is disposed to the recording paper insertion opening 12. The paper insertion detector 35 includes a detection lever 35*a* that protrudes into the fanfold paper transportation path F at the recording paper insertion opening 12, and detects if fanfold paper 11 is present using the retraction of the detection lever 35*a* from the fanfold paper transportation path F caused by the fanfold paper 11 entering the recording paper insertion opening 12.

Figure 4:
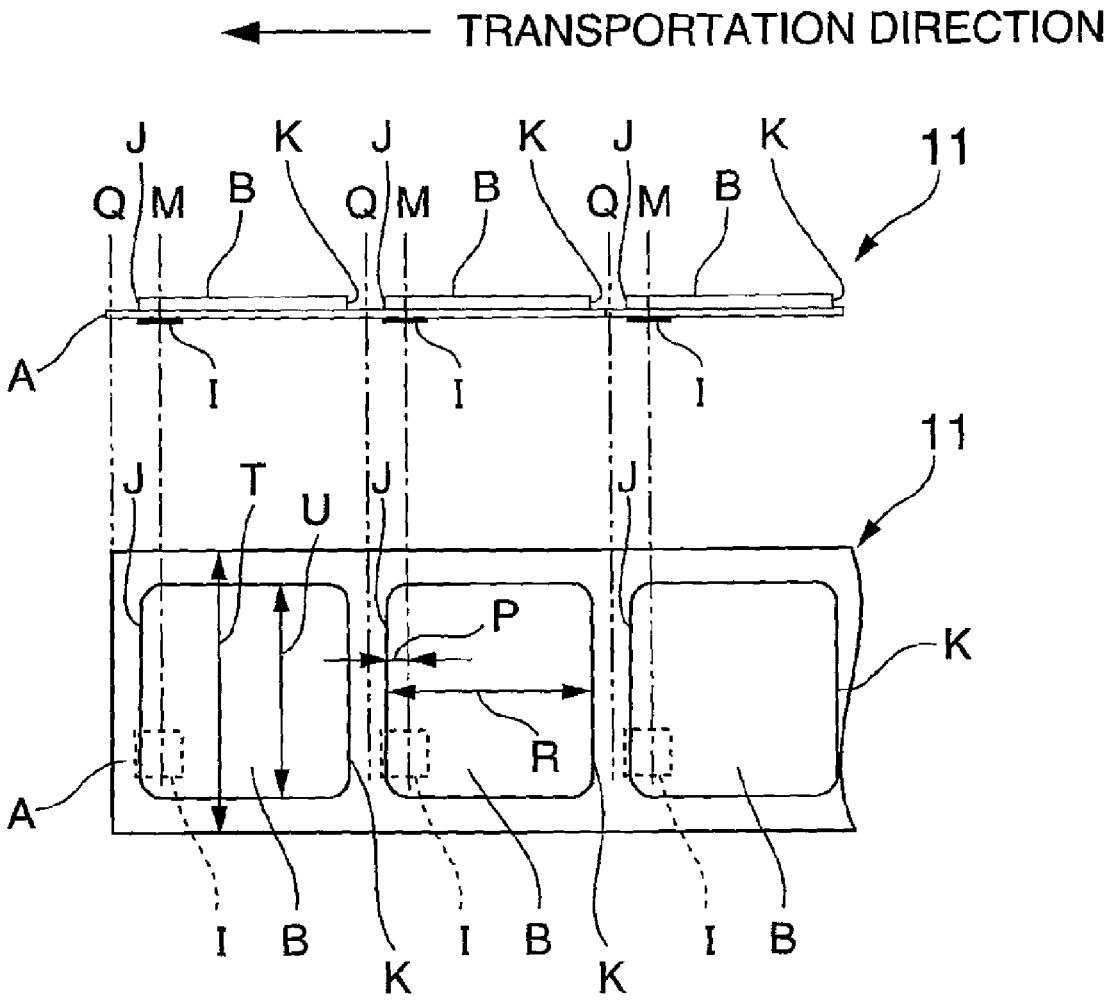
FIG. 4 describes the reference position, target printing start position, and target cutting position.

A reflection photo sensor 36 and a transmission photo sensor 37 for detecting if recording paper 10*a* or fanfold paper 11 is present and detecting the reference position of the recording paper 10*a* or fanfold paper 11 are disposed at an upstream detection position H on the upstream side of the paper feed roller 25 in the common paper transportation path G. FIG. 4 schematically describes the reference position and target printing start position of the fanfold paper 11, which is used here as an example of label paper having labels B affixed with a constant interval there between to a continuous liner A. These reference positions include, for example, index marks I that are rendered for each label B on the recording paper 10*a* or fanfold paper 11, the downstream label end J of each label B, and the upstream label end K of each label B.

The reflection photo sensor 36 uses change in the reflectivity of the emitted detection beam to detect the index marks I. For example, an index mark I is detected when the signal output level of the reflection photo sensor 36 becomes lower than a specific threshold value. The transmission photo sensor 37 uses change in the transmittance of the emitted detection beam to detect the downstream label end J and upstream label end K as reference positions. For example, a downstream label end J is detected when the signal output level of the transmission photo sensor 37 becomes lower than a specific threshold value. When the signal output level of the transmission photo sensor 37 becomes greater than a specific threshold value, an upstream label end K is detected. Note that the threshold values are preset for each type of paper used for printing.

A paper discharge detector 38 for detecting if recording paper 10*a* or fanfold paper 11 is present is disposed at a downstream detection position L on the downstream side of the printing position C of the common paper transportation path G. The paper discharge detector 38 has a detection lever 38*a* that protrudes into the common paper transportation path G at the downstream detection position L, and detects if fanfold paper 11 is present using the retraction of the detection lever 38*a* from the common paper transportation path G when the recording paper 10*a* or fanfold paper 11 is present at the downstream detection position L.

When print data and a print control command specifying printing are received from an external device, the label printer 1 conveys the recording paper 10*a* or fanfold paper 11 along the common paper transportation path G passed the printing position C, and detects a reference position at the upstream detection position H. The label printer 1 also indexes a target printing start position M that is preset for each label B to the printing position C based on when the reference position is detected, and prints using the inkjet head 16. These operations are repeated for each label B on the liner A.

If the user asserts a power off command to turn the power off by operating the power switch 7 after printing the print data is completed, the label printer 1 executes a shutdown operation that turns the power off. The power turns off at this time with the recording paper 10*a* or fanfold paper 11 on the common paper transportation path G positioned as it was when the power off command was asserted. When the power is turned on again, the label printer 1 executes an indexing operation to position the target printing start position M of the label B on the common paper transportation path G to the printing position C, and then enters a standby mode waiting for a print control command and print data.

Control System

Figure 5:
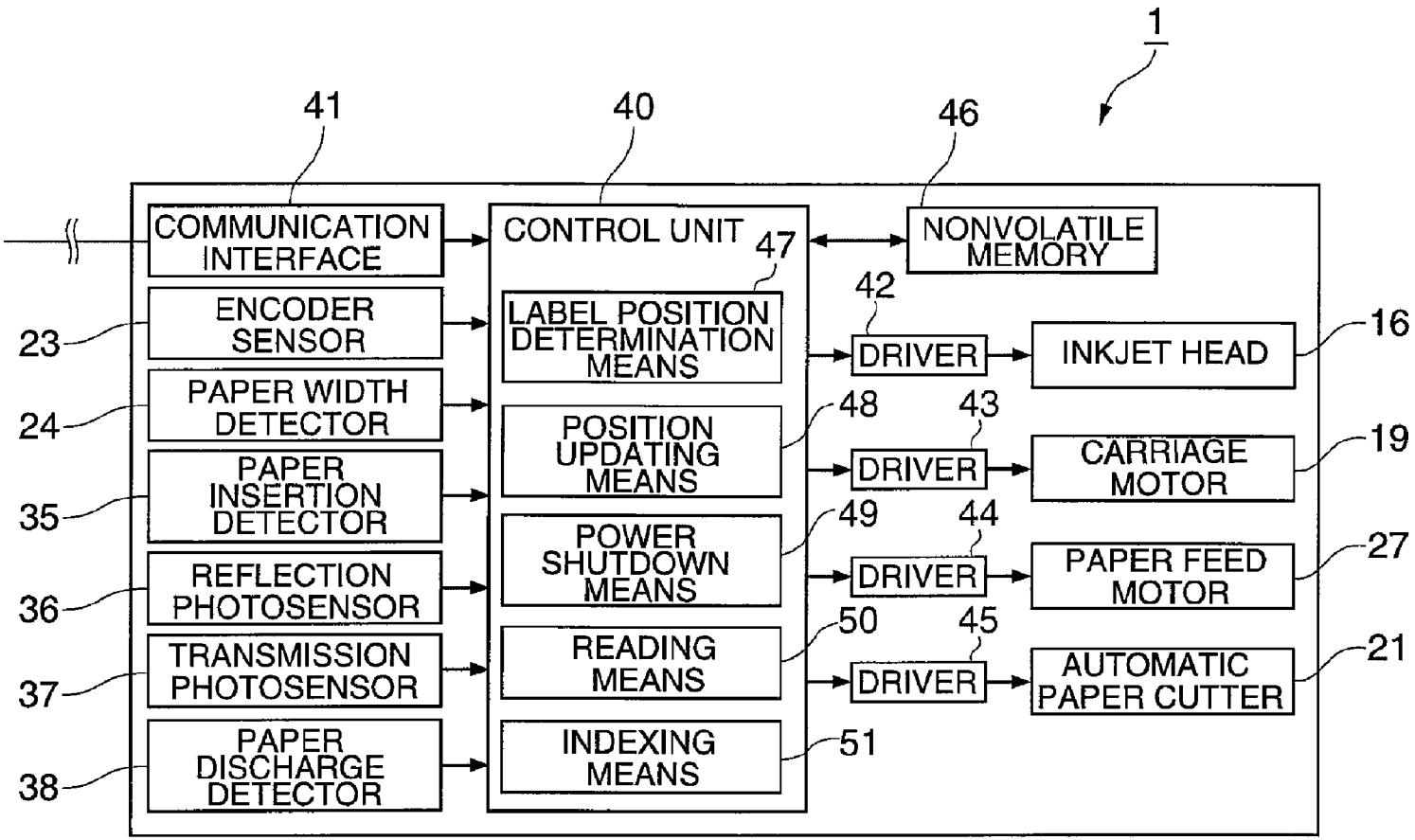
FIG. 5 is a schematic block diagram showing the control system of the label printer.
Figures 6, 7:
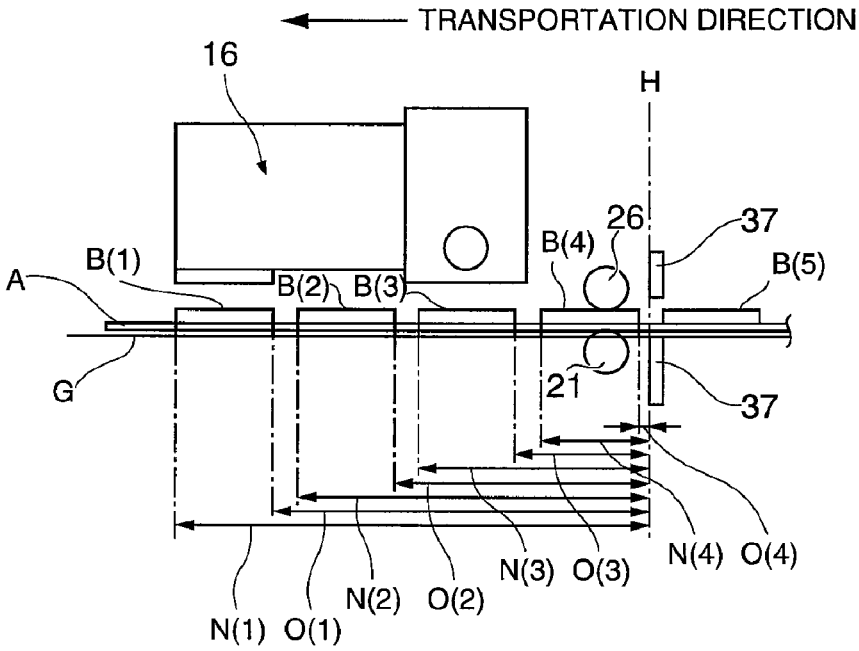
FIG. 6 describes first and second distances referenced to an upstream detection position.
FIG. 7 schematically describes a management table.

FIG. 5 is a schematic block diagram showing the control system of the label printer 1. FIG. 6 schematically shows the fanfold paper 11 on the common paper transportation path G in order to describe a first distance, which is the position of the downstream label end J of the label B on the common paper transportation path G, and a second distance, which is the position of the upstream label end K of the label B. FIG. 7 illustrates a management table that stores and holds the first distance and second distance values correlated to the labels B passing the upstream detection position H.

The control system of the label printer 1 is configured around a control unit 40 that includes a CPU, ROM, and RAM. Print control commands denoting printing, cutting control commands denoting paper cutting, and print data are supplied from a personal computer or other external device through a communication interface 41 to the control unit 40. The encoder sensor 23, paper width detector 24, paper insertion detector 35, reflection photo sensor 36, transmission photo sensor 37, and paper discharge detector 38 are connected to the input side of the control unit 40. The inkjet head 16, carriage motor 19, paper feed motor 27, and automatic paper cutter 21 are connected through a head driver 42 and motor drivers 43, 44, and 45 to the output side of the control unit 40. Nonvolatile memory 46 is also connected to the control unit 40.

The control unit 40 also includes a label position determination means 47, a position updating means 48, a power shutdown means 49, a reading means 50, and an indexing means 51.

The label position determination means 47 controls driving a transportation means including the paper feed motor 27 and the paper feed roller 25 that turns in conjunction therewith to convey the recording paper 10*a* or fanfold paper 11 through the common paper transportation path G, and detects the reference position of the recording paper 10*a* or fanfold paper 11. Based on when this reference position is detected, the label position determination means 47 also determines the positions of the downstream label end J and upstream label end K of the label B on the common paper transportation path G as the first distance N and second distance O, respectively, from the upstream detection position H.

In this embodiment of the invention the reference position is the downstream label end J and upstream label end K of each label B, and these edges are detected based on a threshold value and the signal output level of the transmission photo sensor 37. If the reference position is only the downstream label end J, the second distance O is calculated and determined based on form information contained in the print control command, for example, from an external device. If the reference position is the index mark I, the first distance N and second distance O are calculated and determined based on the dimension between the index mark I on the liner A and the downstream label end J, and the dimension between the index mark I and the upstream label end K. As shown in FIG. 7, the first distances N(1) to N(4) and the second distances O(1) to O(4) are stored as a management table correlated to each of the labels B(1) to B(4) passing the upstream detection position H.

The position updating means 48 updates the first distance N and second distance O each time the paper feed motor 27 is driven and recording paper 10*a* or fanfold paper 11 is conveyed. That is, the position updating means 48 updates the management table.

The power shutdown means 49 writes the management table to the nonvolatile memory 46 when the power switch 7 is operated and a power off command is asserted. The power shutdown operation that turns the power off then starts.

The form information includes information such as the label width of the liner A, the size of the label B, the size of the gap between labels B, whether or not the liner A is transparent, and whether or not there are index marks I.

If the power is turned on without the recording paper 10*a* or fanfold paper 11 being replaced, the reading means 50 reads the management table and form information from the nonvolatile memory 46. The management table values read here are updated by the position updating means 48 each time the recording paper 10*a* or fanfold paper 11 is conveyed. Note that because whether or not the recording paper 10*a* or fanfold paper 11 was replaced cannot be determined while the power is off, the recording paper 10*a* or fanfold paper 11 is not replaced while the power is off.

The indexing means 51 positions the target printing start position M of the label B to the printing position C. More specifically, the indexing means 51 references the information in the management table, and sets the label B that is at the printing position C or the label B that is closest to the printing position C on the upstream side of the printing position C as the target label B for indexing (the "indexing target label B"). The target printing start position M of the selected indexing target label B is then positioned to the printing position C based on the first distance N of the indexing target label B and the margin P from the downstream label end J to the target printing start position M (see FIG. 4).

Indexing Control Operation when the Power Turns on Again

Figure 8:
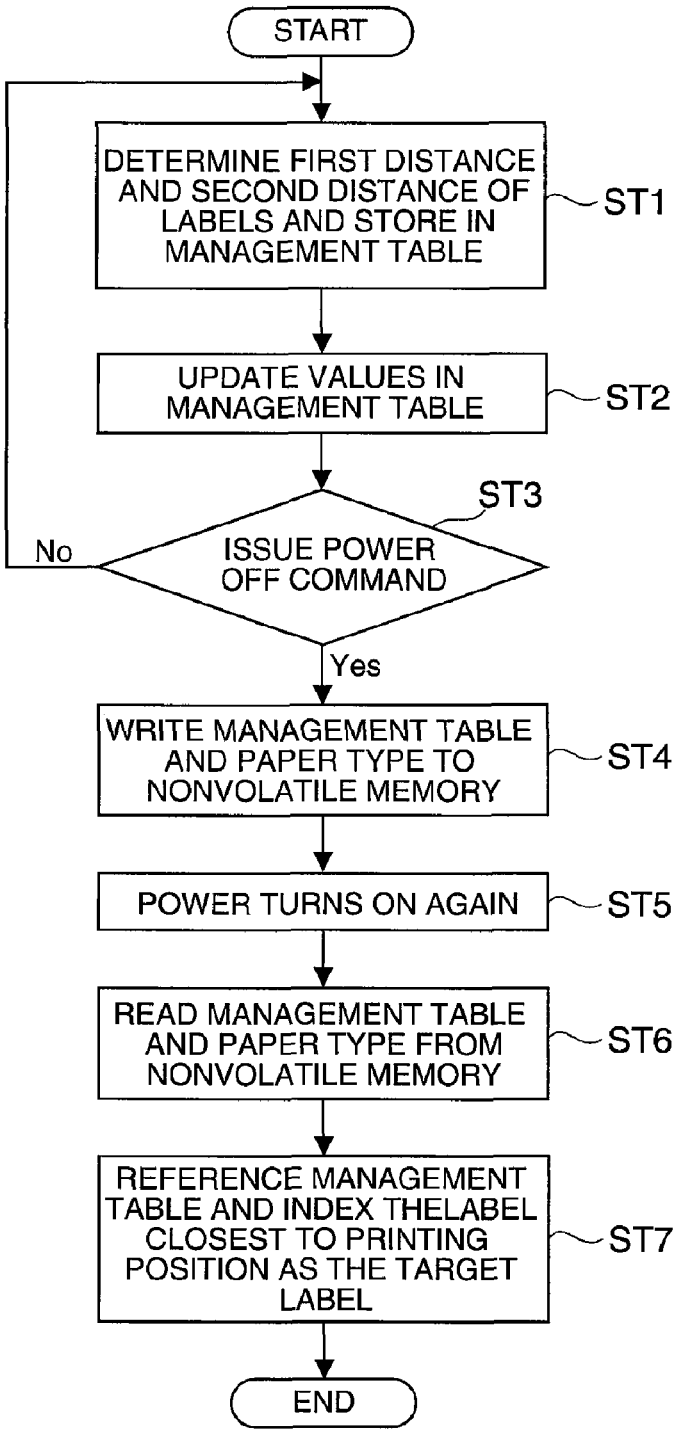

FIG. 8 is a flow chart of the indexing control operation that is executed when the power turns on again.

Print control commands and print data are supplied from an external device to the label printer 1, and the print data is then printed. The print control commands from the external device include the form information and the control unit 40 stores and retains this form information.

While the print data is being printed, the label position determination means 47 detects and stores the first distance N and second distance O of each label B passing the upstream detection position H in the management table (step ST1). The management table values are also updated by the position updating means 48 each time the recording paper 10*a* or fanfold paper 11 is conveyed (step ST2).

When a power off command is asserted (step ST3), the power shutdown means 49 writes the management table and form information to nonvolatile memory 46 and then starts the power shutdown operation (step ST4). The power turns off with the recording paper 10*a* or fanfold paper 11 in the common paper transportation path G positioned as when the power off command was asserted.

When the power turns on again (step ST5), the reading means 50 reads the management table and form information from nonvolatile memory 46 (step ST6).

Because the recording paper 10*a* or fanfold paper 11 is not replaced while the power is off in this embodiment of the invention, the content of the management table and form information read from the nonvolatile memory 46 when the power turns on again matches the recording paper 10*a* or fanfold paper stopped on the common paper transportation path G.

The control unit 40 gets this information when the form information is read. Based on the read management table, the indexing means 51 sets the label B(1) closest to the printing position C as the indexing target label B, and then indexes the target printing start position M of the label B(1) to the printing position C (step ST7). Note that if the recording paper 10*a* or fanfold paper 11 is conveyed during this indexing step, the position updating means 48 updates the management table values.

This embodiment of the invention can use the label B(1) that is closest to the printing position C or that is closest to the printing position C on the upstream side of the printing position C as the indexing target label B because the indexing operation executed immediately after the power turns on again is based on the first distance N determined according to the reference position detected before the power turned off. Because it is not necessary to set a label B(5) of which the reference position is upstream from the upstream detection position H as the indexing target label B when the power turns on, the number of labels B moved downstream from the printing position C by the indexing operation can be reduced or eliminated. The number of labels B that are wasted by the indexing operation after the power turns on again can therefore be reduced.

In addition, when the power turns on again in this embodiment of the invention, the positions of the downstream label end J and upstream label end K on the common paper transportation path G are acquired as the first distance N and second distance O, and these values are updated each time the recording paper 10*a* or fanfold paper 11 is conveyed. Therefore, after the power is turned on again, the position of the gaps between labels B can be determined based on the first distance N and second distance O. In addition, a target cutting position Q (see FIG. 4) that is preset in the gap between the labels B on the liner A can be determined based on the first distance N and second distance O or based on the first distance N or second distance O.

Furthermore, this embodiment of the invention writes the form information to nonvolatile memory 46 when a power off command is asserted, and reads the form information from nonvolatile memory 46 when the power turns on. The control unit 40 can therefore acquire the form information when the power turns on again.

Other Embodiments

When the label position determination means 47 acquires the first distance N, this embodiment of the invention may alternatively acquire and store the distance from the upstream detection position H to the target printing start position M of the label B based on the margin P as a target distance for starting printing in the management table, and this value may be updated by the position updating means 48. In this aspect of the invention indexing can be referenced to this target printing start distance stored in the management table that is read after the power turns on.

Further alternatively, when the label position determination means 47 determines the first distance N and second distance O, this embodiment of the invention may acquire and store the distance from the upstream detection position H to the target cutting position Q on the liner A (see FIG. 4) as a target cutting distance (third distance) in the management table based on the first distance N and second distance O or based on the first distance N or second distance O, and this value may be updated by the position updating means 48. This aspect of the invention can then position the liner A for cutting based on the target cutting distance in the management table read after the power turns on.

Further alternatively, when the label position determination means 47 determines the first distance N, the control unit 40 may acquire the printable length R (see FIG. 4) of the label B in the transportation direction based on the second distance O and first distance N. When a power off command is asserted in this embodiment, the power shutdown means 49 writes the printable length R in nonvolatile memory 46, and when the power turns on, the reading means 50 reads the printable length R from nonvolatile memory 46. If the print length to be printed in the transportation direction of each label B received in the print data supplied after the power turns on exceeds this printable length R, a masking process is applied to not print the part of data exceeding the printable length R in the received print data.

Figure 9A:
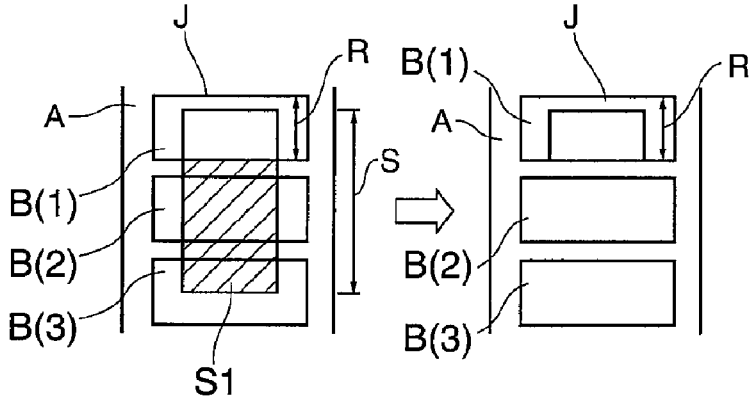
FIG. 9 describes a print data masking process that is applied according to the first and second distances.

For example, as shown in FIG. 9A, the print length S specified in the print data may be erroneously set to a length spanning three labels B. In this situation the control unit 40 calculates the data portion S1 that would be printed passed the printable length R from the downstream label end J of label B (1) if the printing start position is set to the leading label B(1) and print data of print length S is printed, and masks and does not print this data portion S1.

A masking process can thus be applied before printing starts if the printable length R of each label B is known when the power turns on again. As a result, nothing will be printed on the liner A, for example, if the print length of the print data is longer than the printable length R in the transportation direction of the label B as a result of a mistake setting the printing length of the print data. Printing across a plurality of labels B and thus wasting the labels can also be prevented.

The masking process may also be applied to the print data based on the first distance N and second distance O so that the supplied print data is not printed in the gap between labels B when the print head prints after the power turns on.

Figure 9B:
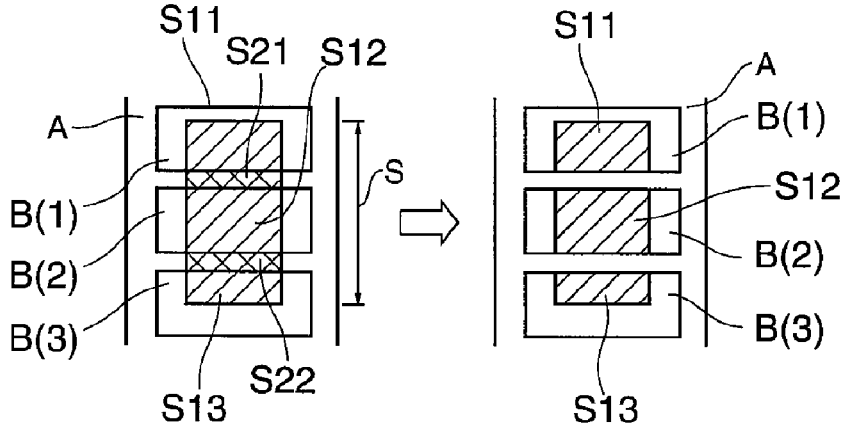

For example, as shown in FIG. 9B, the print length S specified in the print data may be erroneously set to a length spanning three labels B. In this situation the control unit 40 calculates the data portions S11, S12, S13 that would be printed on each label B(1) to B(3), and the data portions S21 and S22 that would be printed in the gaps between labels B based on the first distance N and second distance O of labels B(1) to B(3) if the printing start position is set to the leading label B(1) and print data of print length S is printed from this position, and masks and does not print these data portions S21 and S22.

The printer will therefore not print to the liner A if the print length of the print data is longer than the printable length R in the transportation direction of each label B due, for example, to an error setting the print length of the print data. Note that printing on the liner A can be reliably prevented if the printable length is set with a specific tolerance, such as a narrow range of 1 mm, passed the downstream label end J and upstream label end K.

Further alternatively, the liner width T (see FIG. 4) of the liner A of the recording paper 10*a* or fanfold paper 11 in the common paper transportation path G may be detected based on the output values of the paper width detector 24 and encoder sensor 23 before the first distance and second distance are determined in step ST1. The power shutdown means 49 then writes the liner width T to nonvolatile memory 46 when the power off command is asserted, and when the power then turns on the reading means 50 reads the liner width T from nonvolatile memory 46. If the print width of the print data supplied after the power turns on is greater than liner width T, a masking process is applied so that the part of the print data that would be printed outside the line width T or outside a label width U (see FIG. 4) that is a specific dimension narrower than the liner width T is not printed.

Figure 10:
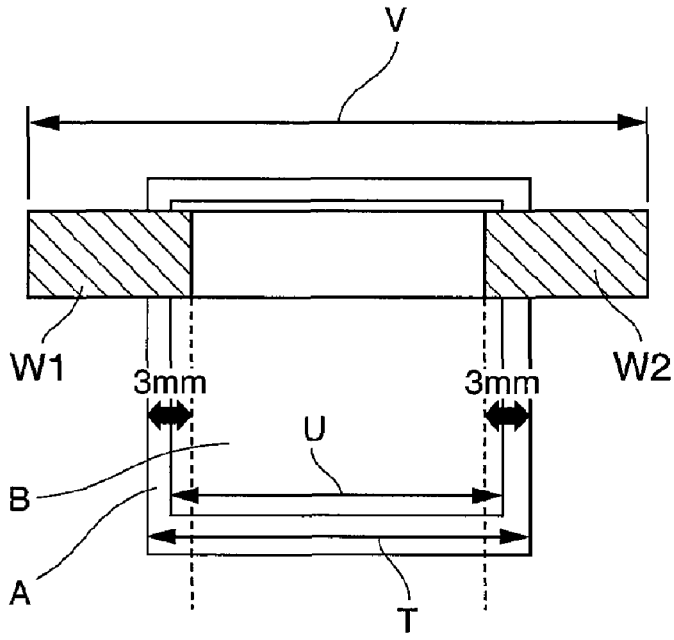
FIG. 10 describes a print data masking process that is applied based on the liner width.

For example, as shown in FIG. 10, if the printing width V set in the print data is greater than the liner width T of the liner A due to a setting error, for example, the control unit 40 calculates the data portions W1 and W2 that are outside a narrow margin of 3 mm, for example, on the left and right sides of the liner width T in the print data, and masks and does not print these data portions W1 and W2.

If the liner width T of the liner A is known when the power turns on again, a masking process can thus be applied to the print data before printing starts. If the printing width of the print data is greater than the liner width T of the liner A due, for example, to an error setting the print width of the print data, printing outside the liner A and soiling the platen or other member guiding the liner A, for example, can therefore be avoided. Furthermore, because it is possible to not print the data that would be printed outside the label width U if the print data is masked to a range narrower than the liner width T, printing on the liner A can be avoided.

In addition, because the reference position is detected based on a threshold value and the output levels of signals from the reflection photo sensor 36 and transmission photo sensor 37, the power shutdown means 49 can write the threshold values as sensor settings in nonvolatile memory 46 when a power off command is asserted, and when the power then turns on again the reading means 50 can read the sensor settings from the nonvolatile memory 46 and set them as the threshold values. This aspect of the invention enables detecting the reference positions using appropriate threshold values when the threshold values are selectively used based on the paper type.

Further alternatively, the power shutdown means 49 can start the power shutdown operation when a power off command controlling the power shutdown operation for shutting the power off is asserted, and can write the management table and paper type to the nonvolatile memory 46 while the power supply voltage is reduced by the electrostatic capacitance of the rectification and voltage drop prevention capacitors of the power supply circuit. Because this aspect of the invention enables saving the management table and paper type information to nonvolatile memory while the power shutdown operation executes, the time from when the power off command is asserted until the power turns off can be shortened compared with a configuration in which the power shutdown operation starts after the management table and paper type information are written to nonvolatile memory 46.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A label paper indexing control method for a label printer, comprising steps of:

conveying label paper having labels affixed with a specific gap there between to a continuous liner through a paper transportation path passed a printing position of a print head;

detecting a reference position of the label paper at a detection position upstream from the print head;

determining the position of a downstream label end of a label on the paper transportation path as a first distance from the detection position based on when the reference position is detected;

updating the first distance each time the label paper is conveyed;

executing a power shutdown operation that writes the first distance to nonvolatile memory and turns the power off when a power off command instructing turning the power off is asserted;

reading the first distance from the nonvolatile memory when the power turns on; and indexing a target printing start position that is predetermined for the label to the printing position based on the first distance.

2. The label paper indexing control method for a label printer described in claim 1, further comprising steps of:

determining the position of an upstream label end of the label on the paper transportation path as a second distance from the detection position based on when the reference position is detected;

updating the second distance each time the label paper is conveyed;

executing the power shutdown operation that writes the second distance to the nonvolatile memory and turns the power off when the power off command instructing turning the power off is asserted; and reading the second distance from the nonvolatile memory when the power turns on.

3. The label paper indexing control method for a label printer described in claim 2, wherein a cutting position is located on the downstream side of the print head on the paper transportation path, further comprising steps of:

determining a position on the paper transportation path as a third distance from the detection position a target cutting position based on the first distance and/or the second distance;

writing the third distance to the nonvolatile memory when the power off command is asserted; and reading the third distance from the nonvolatile memory when the power turns on.

4. The label paper indexing control method for a label printer described in claim 2, further comprising steps of:

acquiring a printable length in the transportation direction of the label based on the first distance and/or the second distance;

writing the printable length to the nonvolatile memory when the power off command is asserted; and applying a masking process when the print length in the transportation direction of the supplied print data that is printed to the label exceeds the printable length so that the part of the print data other than the data corresponding to the printable length does not print.

5. The label paper indexing control method for a label printer described in claim 2, further comprising steps of:

applying a masking process to the print data based on the first distance and the second distance so that the supplied print data is not printed in the gaps between labels when printing after the power turns on.

6. The label paper indexing control method for a label printer described in claim 1, further comprising steps of:

acquiring a liner width of the liner paper on the paper transportation path;

writing the liner width to the nonvolatile memory when a power off command is asserted;

reading the liner width from the nonvolatile memory when the power turns on; and applying a masking process when the printing width of the supplied print data is greater than the liner width so that the data portion of the print data that is to be printed outside the liner width or outside a label width of the label paper is not printed, the label width being narrower by a specific dimension than the liner width.

7. The label paper indexing control method for a label printer described in claim 1, further comprising steps of:

writing the paper type of the label paper acquired based on a control command from an external device to the nonvolatile memory when the power off command is asserted; and reading and acquiring the paper type from the nonvolatile memory when the power turns on.

8. The label paper indexing control method for a label printer described in claim 7, wherein a photo sensor is set to the detection position, further comprising steps of:

setting a specific threshold value according to an output level of a signal from a photo sensor and/or according to the paper type;

detecting the reference position based on the output level and threshold value;

writing the threshold value as a sensor setting value to the nonvolatile memory when the power off command is asserted; and reading and setting the sensor setting value from the nonvolatile memory as the threshold value when the power turns on, wherein the photo sensor is et to the detection position.

9. The label paper indexing control method for a label printer described in claim 2, further comprising a step of:

starting the power shutdown operation when the power off command is asserted, and writing the first distance and the second distance to the nonvolatile memory while the circuit voltage drops.

10. A label printer that indexes label paper, comprising:

a print head;

a nonvolatile memory; and, a control unit that executes the indexing control method described in claim 1 using the print head and the nonvolatile memory.

11. The label paper indexing control method for a label printer described in claim 2, wherein:

the target printing start position that is predetermined for the label is based on the first distance and the second distance.

* * * * *